US005876103A

United States Patent [19]

Domenig

[11] Patent Number: 5,876,103

[45] **Date of Patent: *Mar. 2, 1999**

[54] SELF-POSITIONING CABINET RAIL FOR A DRAWER GUIDE

[75] Inventor: Georg Domenig, Kernersville, N.C.

[73] Assignee: Grass America, Inc., Kernersville, N.C.

[ * ] Notice: The term of this patent shall not extend beyond the expiration date of Pat. No. 5,722,749.

[21] Appl. No.: 938,773

[22] Filed: Sep. 26, 1997

Related U.S. Application Data

[63] Continuation-in-part of Ser. No. 658,743, Jun. 5, 1996, Pat. No. 5,722,749.

[51] Int. Cl.[6] ..... A47B 88/00

[52] U.S. Cl. ..... 312/334.4; 312/330.1; 312/334.12; 312/334.14; 312/334.44; 312/334.46

[58] Field of Search ..... 312/334.4, 330.1, 312/334.1, 334.7, 334.12, 334.14, 334.18, 335.44, 334.46, 334.45

[56] References Cited

U.S. PATENT DOCUMENTS 5,470,144 11/1995 Wen ..... 312/330.1 X
5,490,724 2/1996 Domenig ..... 312/334.44 X
5,556,182 9/1996 Lai ..... 312/334.4
5,564,807 10/1996 Rock et al. ..... 312/334.12 X
5,785,400 7/1998 Grieser et al. ..... 312/334.12

*Primary Examiner*—Peter M. Cuomo
*Assistant Examiner*—James O. Hansen
*Attorney, Agent, or Firm*—John M. Harrington; Kilpatrick Stockton LLP

[57] ABSTRACT

A self-positioning cabinet rail for a drawer guide for supporting a drawer in a drawer opening of a furniture article such as a cabinet includes a rail member with front and rear ends, upper and lower ledges, a cabinet rail roller and a projection on the front end of the rail member extending substantially parallel to the longitudinal axis of the rail member. An extension member of a resilient or semiresilient material is disposed on the projection and extends below the bottom margin of the front end of the rail member to properly space the cabinet rail from the bottom of the drawer opening. The extension member also extends forward of the front margin of the front end of the rail member to provide an abutment surface or stop for the drawer front.

20 Claims, 4 Drawing Sheets

SELF-POSITIONING CABINET RAIL FOR A DRAWER GUIDE

This application is a continuation-in-part of my U.S. patent application Ser. No. 08/658,743 filed Jun. 5, 1996, U.S. Pat. No. 5,722,749.

BACKGROUND OF INVENTION

1. Field of the Invention

The subject invention is generally related to a drawer guide for supporting a moveable structure, such as a drawer, in a furniture article and is specifically directed to a self-positioning cabinet rail for supporting a pull-out rail of a drawer guide in a drawer opening, the cabinet rail including a downwardly bent projection for spacing the cabinet rail from the bottom of the drawer opening. Alternatively, it is not necessary to bend the projection, but rather the projection may extend parallel to the cabinet rail with an extension member disposed on the projection to space the cabinet rail from the bottom of the drawer opening and also to provide a stop for the drawer front.

2. Description of the Prior Art

Various types of pull-out drawer guides have been used in furniture such as cabinets, desks and the like for supporting drawers and similar moveable structure for many years. One such type of drawer guide has guide rails mountable to a furniture article and pull-out rails carrying the moveable structure, both of which are provided with rollers. The pull-out rail may support a drawer, a bin, a board or the like, and the respective rollers enable the pull-out guide and carried structure to be moved freely and without resistance between a forward, open position and a rearward, closed position.

Typically, this type of drawer guide includes a U-shaped guide rail and a Z-shaped pull-out rail. The U-shaped guide rail is mountable to a furniture article, such as a cabinet and serves as a track on which the Z-shaped pull-out rail and supported drawer rolls in and out of the drawer opening. The guide rail is made by first stamping out an elongate rectangular blank from a web of sheet metal and thereafter shaping by bending the long edges to form the upper and lower legs of the U-shaped cross section. Thus, the width of the blank is determined by the required dimensions of the U-shaped cross-section, which limits the width of the front end of the guide rail.

One disadvantage of this type of drawer guide is that when the pull-out rail is placed on the "track", the bottom leg of the Z-shaped pull-out rail, often extends below the bottom edge of the guide rail. The result is that the bottom leg of the pull-out rail and the supported drawer do not clear the lower member of the drawer opening. Thus, it is necessary that the guide rail be spaced and mounted a pre-determined distance above the lower member of the drawer opening to enable the pull-out rail and supported drawer to clear it.

One approach to positioning the guide rail a pre-determined space above the bottom of the drawer opening would be to provide a workman with a specially designed jig for pre-drilling holes for screws or the like for mounting the guide rail at the correct pre-determined distance. Alternatively, a workman could use a separate spacer which would be placed between the guide rail and lower member of the drawer opening while mounting the guide rail to the cabinet to ensure that the proper spacing is attained. However, either solution would be costly and time consuming.

Another solution would be to make the entire front end of the cabinet rail wider by a distance equal to the required space so that aligning the bottom of the front end of the cabinet rail with the lower member of the drawer opening provides the required spacing. Although conceivably the blank of sheet metal could be stamped out in irregular shape with a wider end or perhaps trimmed that way, this would require altering the current specifications for making the guide rails and the cost in wasted sheet metal alone would be enormous.

Therefore, there is a need for a means which provides an inexpensive, readily accessible way to mount the guide rail for a drawer guide the required spaced distance above the lower member of a drawer opening so that the pull-out rail and supported drawer clear the opening.

SUMMARY OF THE INVENTION

The subject invention is directed to a self-positioning cabinet rail for a drawer guide for supporting a drawer in a drawer opening of a furniture article, such as a cabinet, and includes a means for spacing the cabinet rail from the bottom of the drawer opening. The self-positioning cabinet rail of the subject invention is designed for a drawer guide of the type having a generally U-shaped guide rail which is mountable to a furniture article and a generally Z-shaped pull-out rail which is fastened to a drawer and engages the U-shaped guide rail. In use, the U-shaped guide rail is mounted to a furniture article with its front end at the drawer opening and serves as a track on which the pull-out rail and supported drawer moves in and out of the drawer opening. In this particular type of drawer guide, the bottom leg of the Z-shaped pull-out rail, which supports the bottom of the drawer, often extends below the level of the front end of the cabinet rail. Thus, if the U-shaped guide rail is mounted with its front end even with the drawer opening, the bottom leg of the Z-shaped pull-out rail and bottom of the drawer will be positioned below that and thus, unable to clear the bottom edge of the drawer opening.

The subject invention is specifically directed to a cabinet rail which includes a downwardly bent projection on the front end of the cabinet rail for properly positioning the cabinet rail a spaced distance from the bottom of the drawer opening to enable the pull-out rail and supported drawer to easily move in and out of the drawer opening.

The cabinet rail of the subject invention includes a rail member having front and rear ends and a generally U-shaped cross-section with upper and lower ledges. The cabinet rail also includes a cabinet rail roller mounted near its front end. The projection on the front end of the rail is angled downward to extend below the bottom edge of the front end of the cabinet rail. In use, the front end of the cabinet rail is positioned at the drawer opening so that the projection is aligned with the bottom edge of the drawer opening. Thus, the projection provides a readily available and inexpensive means for properly spacing the cabinet rail the required distance above the bottom edge of the drawer opening so that the pull-out rail and supported drawer are able to easily move in and out of the drawer opening.

In the preferred embodiment, the projection is formed by creating a notch in the front end of the cabinet rail such that a small section of the rail member is separated on one side of the notch. The section is then bent in a downwardly direction to define the projection on the front end of the rail. Thus, the subject invention provides an inexpensive and efficient means for spacing the cabinet rail which utilizes existing cabinet rail specifications and does not require additional materials.

The self-positioning cabinet rail of the subject invention may also include a bumper cover adapted to be placed on the projection for providing an abutment surface or stop for the front of the drawer as it is rolled closed into the drawer opening. The bumper cover is made of a resilient or semi-resilient material, such as by way of example, a plastic material and extends forward from the front end of the guide rail. The bumper cover is designed to extend slightly forward of the face of the cabinet so that the front of the drawer contacts the bumper cover instead of directly abutting the face of the cabinet frame. By providing a bumper cover, the need to add self-adhesive cushions along abutting surfaces to protect the cabinet frame and drawer front is eliminated.

In an alternative embodiment, it is not necessary to bend the small section of the rail member on one side of the notch to form a downwardly bent projection on the front end of the rail member, but rather the section may be allowed to remain in the unbent condition in which it defines a projection on the front end of the rail member which extends substantially parallel to the longitudinal axis of the rail member. In addition, the alternative embodiment includes an extension member which is designed to be formed on or to fit snugly on the projection and to extend in at least one of a direction beyond the front margin of the front end of the rail member and a direction below the bottom margin of the front end of the rail member. While the extension member may extend in either direction, preferably it extends in both directions. In any event, omission of the bending step according to the alternative embodiment saves time and expense in the fabrication process.

While the shape of the extension member may take any suitable form, preferably it takes the form of a six-sided parallelepiped with a front side disposed beyond the front margin of the front end of the rail member, a bottom side disposed below the bottom margin of the front end, and a rear side opposite the front side and perpendicular to the bottom side. An opening is formed in the rear side to receive the projection of the rail member with a top side of the extension member disposed adjacent an upper marginal edge of the notch. The opening is disposed proximate a lateral edge of the rear side of the extension member in order to offset the extension member toward the face side of the cabinet rail to enable relatively flush mounting of the side opposite the face side of the cabinet rail to the cabinet wall. The extension member may be fabricated of any suitable material, but exceptional success has been found using a resilient or semi-resilient material such as rubber or plastic.

In use, the cabinet rail is mounted in the cabinet with the front side of the extension member disposed beyond the front margin of the front end of the rail member and extending slightly beyond the cabinet front to provide an abutment surface between the cabinet and the drawer front. Further, the bottom side of the extension member is disposed below the bottom margin of the front end of the rail member and is aligned with a lower cabinet member to space the cabinet rail a predetermined distance above the lower member of the drawer opening. The predetermined distance is determined by the size of the corresponding Z-shaped pull-out rail and the distance required to enable the lower leg of the Z-shaped rail to clear the lower member of the drawer opening.

Therefore, it is an object and feature of the subject invention to provide a self-positioning cabinet rail for a drawer guide of the type having a U-shaped guide rail and Z-shaped pull-out rail, which includes an inexpensive, readily accessible means for positioning the cabinet rail from the bottom of the drawer opening such that a supported drawer easily moves in and out of the drawer opening.

It is an additional object and feature of the subject invention to provide a self-positioning cabinet rail for a drawer guide having a downwardly bent projection on the front end of the cabinet rail which is aligned with the drawer opening to space the cabinet rail a pre-determined distance from the bottom of the drawer opening.

It is another object and feature of the subject invention to provide a self-positioning cabinet rail for a drawer guide having a bumper cover on the projection for providing an abutment or stop surface for the front of the drawer when the drawer is rolled into the drawer opening.

Other objects and features will be readily apparent from the accompanying drawings and description.

DETAILED DESCRIPTION OF THE DRAWINGS

Figure 1:
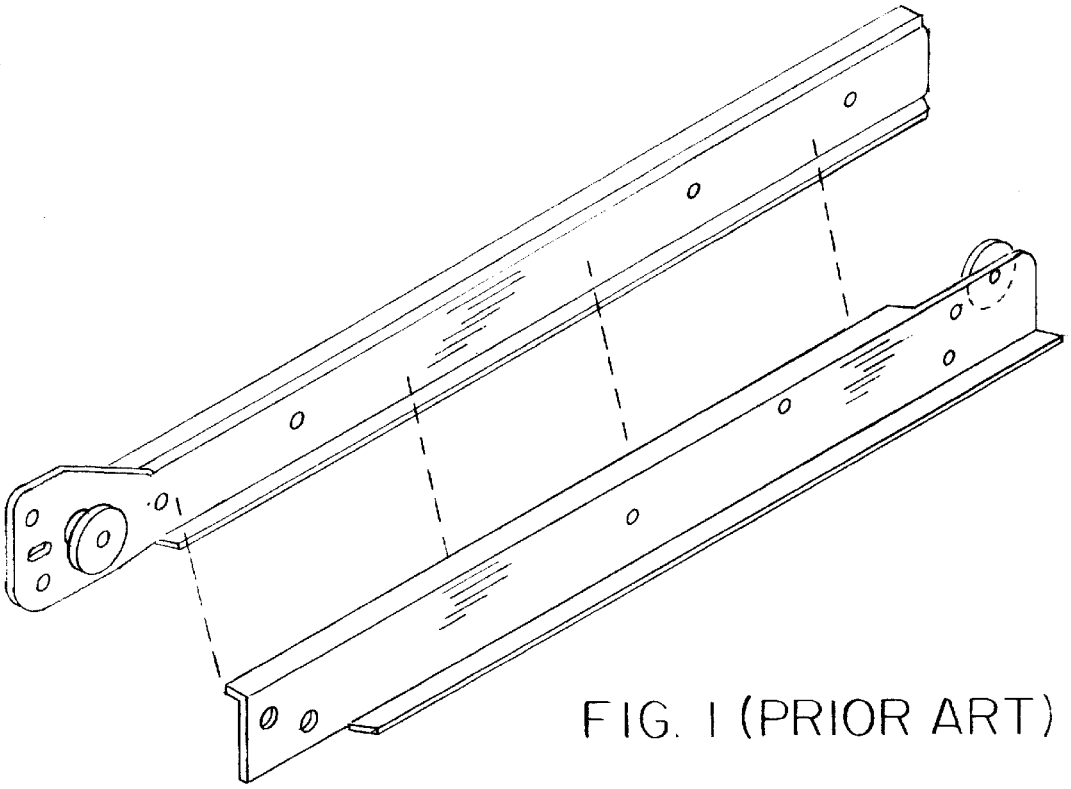
FIG. 1 (PRIOR ART)
FIG. 1 (PRIOR ART) is a perspective view of a drawer guide for supporting a drawer illustrating a U-shaped guide rail which serves as a track for a Z-shaped pull-out rail which supports the drawer in a drawer opening.
Figure 2:
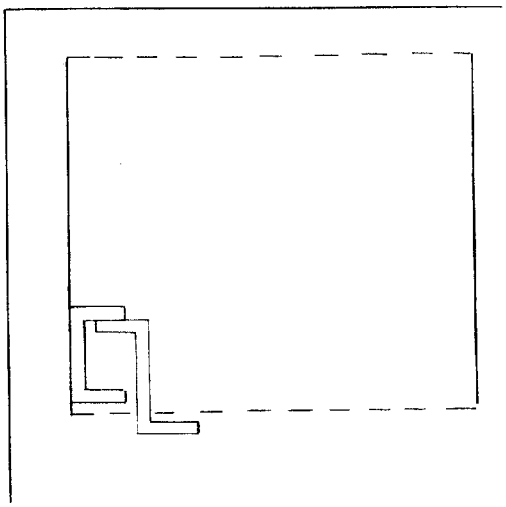
FIG 2 (PRIOR ART)
FIG. 2 (PRIOR ART) is cross-sectional front view of the drawer guide mounted in a drawer opening and showing the undesirable positioning of the lower leg of the Z-shaped pull-out rail below the bottom of the drawer opening.

FIGS. 1 and 2 illustrate the prior art drawer guide for supporting a moveable structure, such as a drawer, a bin, a board or the like, in a furniture article, such as a cabinet (not shown). Typically, a cabinet includes a drawer opening defined by side walls and upper and lower members. A drawer guide may be attached directly to a side wall, or if the cabinet has a face frame, the drawer guide may be fastened to a side member of the frame. As shown, the drawer guide of the prior art includes a guide rail with a generally U-shaped cross section and a guide rail roller mounted on its front end, and a pull-out rail with a generally Z-shaped cross section and a pull-out roller mounted on its rear end.

In use, the guide rail is mounted to the cabinet with its front end positioned at or near the lower member of the drawer opening. The lower leg of the Z-shaped pull-out rail is fastened to the bottom of a drawer, and the upper leg of the Z-shaped pull-out rail is rollingly supported by the guide rail roller. The lower leg of the U-shaped guide rail rollingly supports the pull-out rail roller. When the drawer is in the pulled out position, the pull-out rail roller engages the upper leg of the U-shaped guide rail so that the upper leg prevents the drawer from cantilevering forward.

While the prior art drawer guide works to provide support for a moveable structure, such as a drawer, in a furniture article and enables the drawer to move freely between a forward, open position and a rearward, closed position, one problem is that the bottom leg of the Z-shaped pull-out rail typically extends below the bottom edge of the front end of the cabinet rail (see FIG. 2). The result is that the bottom of the drawer does not clear the lower member of the drawer opening. Thus, it is necessary that the guide rail be spaced a pre-determined distance above the drawer opening to enable the pull-out rail and supported drawer to clear the lower member of the drawer opening. One solution to properly positioning the guide rail in the drawer opening would be to provide a specially designed jig for pre-drilling holes for screws or the like for mounting the guide rail a pre-determined distance above the lower member of the drawer opening. Another solution would be to provide a separate spacer which is placed between the guide rail and lower member of the drawer opening while mounting the guide rail to the cabinet such that the proper spacing is attained. However, either solution is costly and time consuming.

The self-positioning cabinet rail of the subject invention addresses the problem of correctly positioning the cabinet rail and provides a cabinet rail which includes a projection which when aligned with the lower member of the drawer opening correctly spaces the cabinet rail.

Figure 3:
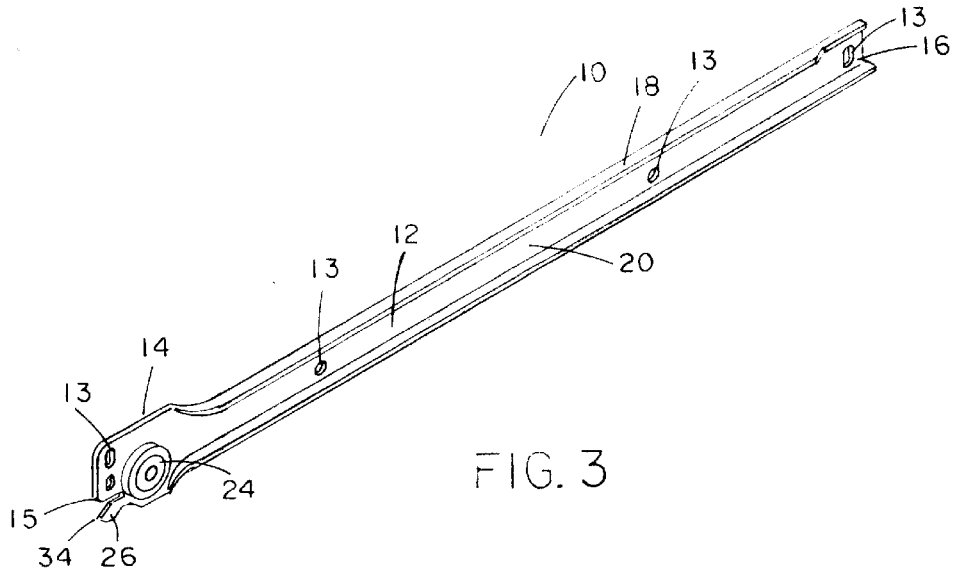
FIG. 3 is a perspective view of the self-positioning cabinet rail having front and rear ends, upper and lower ledges, a cabinet rail roller and a downwardly bent projection at its front end.

The subject invention is shown in FIGS. 3–7 and is specifically directed to a self-positioning cabinet rail 10 for a drawer guide of the type have a U-shaped guide rail and a Z-shaped pull-out rail. As shown in FIG. 3, the cabinet rail 10 includes a rail member 12 having front and rear ends 14 and 16. The rail member includes upper and lower ledges 18, 20 extending along substantially the entire length of the rail member 12 and forming a substantially U-shaped cross section. As shown in FIGS. 3–7, the cabinet rail 10 includes a cabinet rail roller 24 rotatably mounted near its front end 14. The front end 14 has a bottom edge 15 which is slightly lower than the lower ledge 20 of the cabinet rail.

The self-positioning cabinet rail 10 includes a downwardly bent projection 26 on its front end 14 extending below the bottom edge 15 of the front end. The projection 26 is formed by creating a notch 28 in the front end 14 of the cabinet rail 10 so that a small section 30 of the rail member 12 is separated on one side of the notch (see FIG. 4A). As shown in FIG. 4B, the section 30 is then bent in a downwardly direction to define the projection 26 on the front end 14 of the cabinet rail 10.

Figure 5:
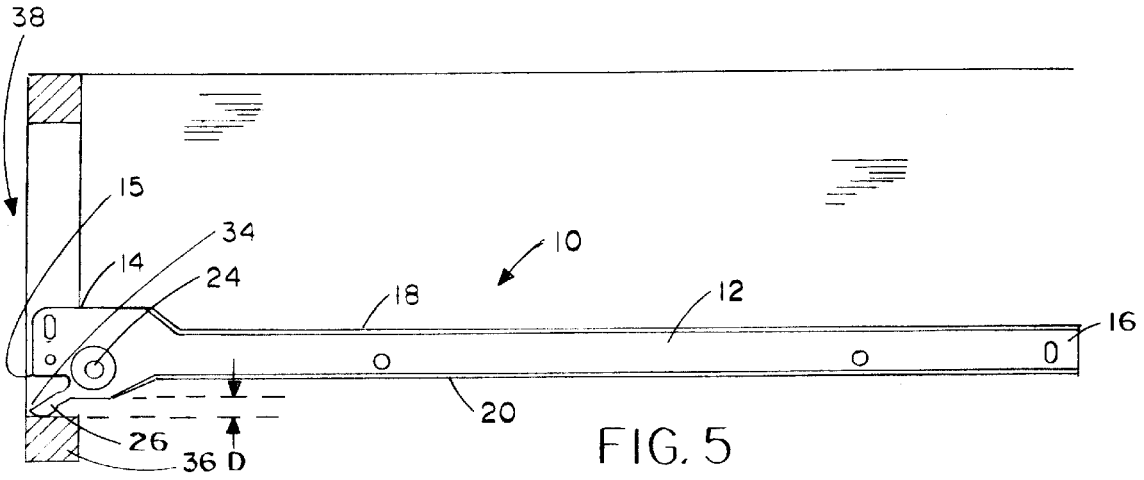
FIG. 5 is a side view of the cabinet rail mounted in a cabinet with the projection aligned with the drawer opening to properly space the cabinet rail above the bottom of the drawer opening.

As shown in FIG. 5, in use, an outer tip 34 of the projection 26 is aligned with a lower member 36 of a drawer opening 38 to space the cabinet rail 10 a predetermined distance D above the lower member 36 of the drawer opening 38. The projection 26 may be angled downward at an angle A as determined by the size of the corresponding Z-shaped pull-out rail and the required distance to enable the lower leg of the Z-shaped rail to clear the lower member 36 of the drawer opening 38. In the preferred embodiment, the angle A is approximately 33 degrees or 44 degrees but may be varied as necessary to correctly position the cabinet rail 10 in the drawer opening.

Figure 6:
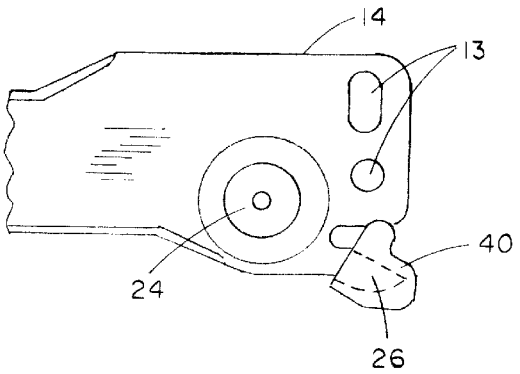
FIG. 6 is an enlarged side view of the front end of the cabinet rail including a bumper cover on the projection which extends forward of the front end.
Figure 7:
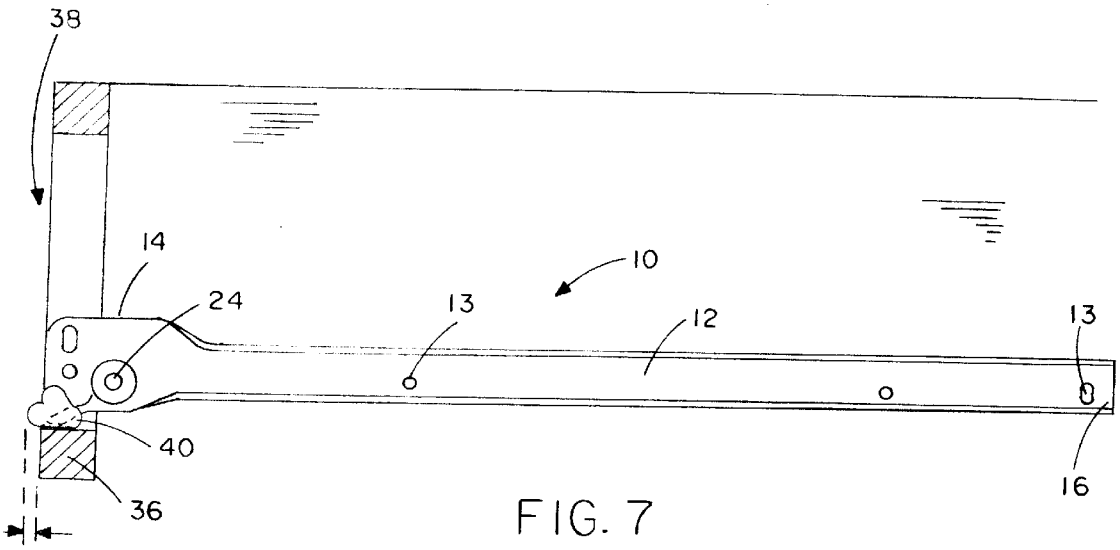
FIG. 7 is a side view of the cabinet rail mounted in a cabinet and including the bumper cover on the projection which extends forward of the front end and provides an abutment or stop surface for the drawer front as it is closed.

In addition, the preferred embodiment includes a sleeve or bumper cover 40 which is designed to fit snugly on the projection 26 on the front end 14 of the cabinet rail 10 (See FIG. 6). As shown in FIG. 7, the bumper cover 40 extends forward of the front end 14 of the cabinet rail and extends slightly beyond the cabinet front to provide an abutment surface between the cabinet and the front of the drawer. In the preferred embodiment, the bumper cover 40 extends approximately 3 millimeters forward of the front end of the cabinet rail 10 and is made of a plastic material. However, it will be understood that the cover 40 may be any resilient or semiresilient material which provides a cushioning surface.

Figure 4A:
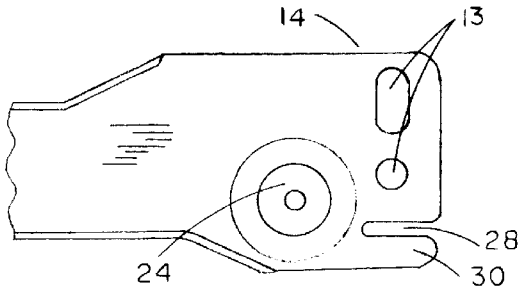
FIG. 4A is an enlarged side view of the front end of the cabinet rail having a notch formed in the rail member with a small section of the rail member on one side of the notch.
Figure 4B:
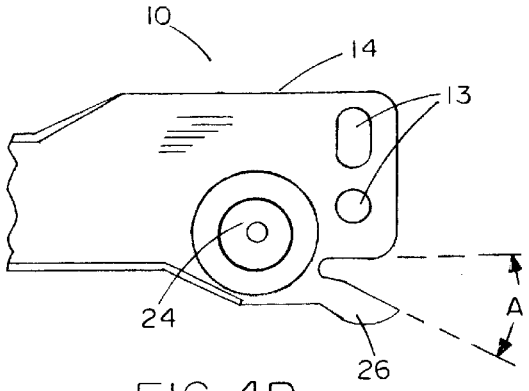
FIG. 4B is an enlarged side view of the front end of the cabinet rail illustrating the section bent away from the notch in a downwardly direction to define a projection angled to extend below the bottom edge of the front end.
Figure 8:
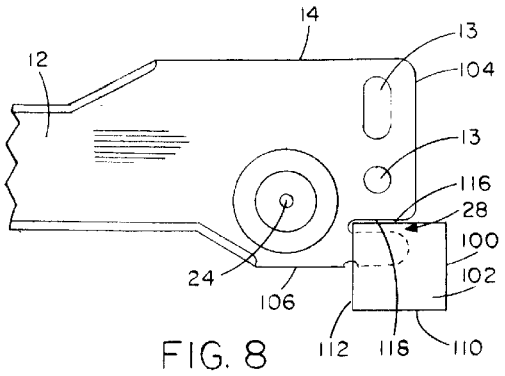
FIG. 8 is a side view of the front end of an alternate embodiment cabinet rail including an extension member on the projection which properly spaces the cabinet rail above the bottom of the drawer opening and provides an abutment or stop surface for the drawer front as it is closed.
Figure 9:
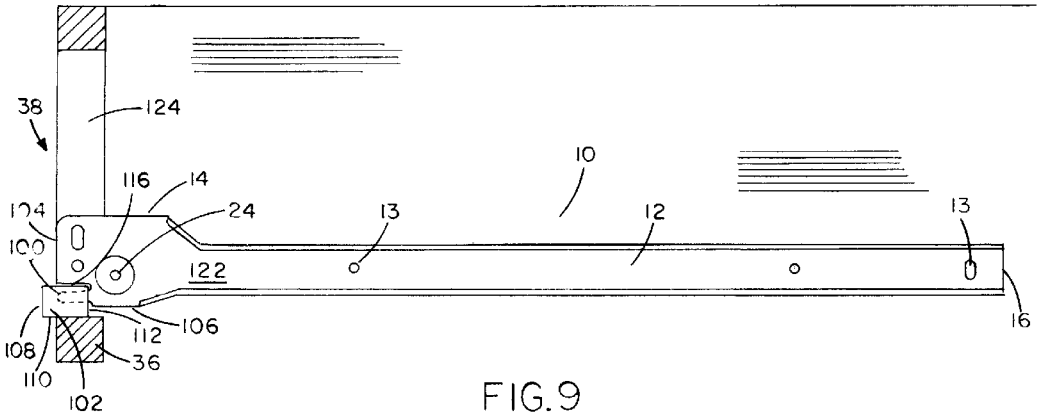
FIG. 9 is a side view of the cabinet rail of FIG. 8 mounted in a cabinet and including the extension member on the projection.

In an alternative embodiment, it is not necessary to bend section 30 of rail member 12 to form downwardly bent projection 26, but instead section 30 may be allowed to remain in an unbent condition, as shown in FIG. 4A. In the unbent condition, section 30 defines a projection 100 on the front end 14 of rail member 12 which extends substantially parallel to the longitudinal axis of rail member 12, as shown in FIGS. 8 and 9. In addition, the alternative embodiment includes an extension member 102, as shown in FIGS. 8–15, which is designed to fit snugly on the projection 100 and to extend in at least one of a direction beyond the front margin 104 of front end 14 of rail member 12 and a direction below the bottom margin 106 of front end 14 of rail member 12. While extension member 102 may extend in either direction, preferably it extends in both directions as shown in FIGS. 8 and 9.

Figure 15:
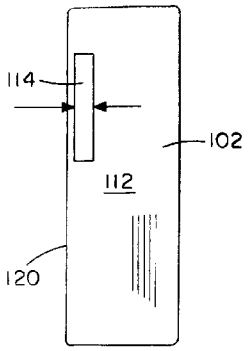
FIG. 15 is a enlarged rear view of the extension member as shown in FIGS. 8–14.
Figure 12:
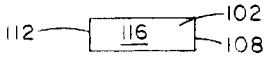
FIG. 12 is a top view of the extension member as shown in FIGS. 8–11.
Figure 11:
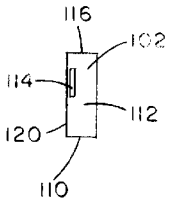
FIG. 11 is a rear view of the extension member as shown in FIGS. 8–10.
Figure 10:
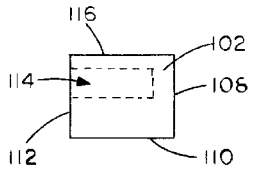
FIG. 10 is a side view of the extension member as shown in FIGS. 8 and 9.
Figure 13:
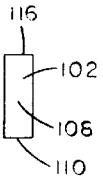
FIG. 13 is a front view of the extension member as shown in FIGS. 8–12.
Figure 14:
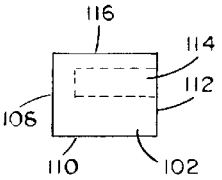
FIG. 14 is an opposite side view of the extension member as shown in FIGS. 8–13.

While it will be appreciated that the shape of extension member 102 may take any suitable form, preferably it takes the form of a 6-sided parallelepiped as shown in FIGS. 10–14, with a front side 108 disposed beyond the front margin 104 of front end 14, a bottom side 110 disposed below the bottom margin 106 of front end 14, and a rear side 112 opposite front side 108 and perpendicular to bottom side 110. An opening 114 is formed in rear side 112 to receive projection 100 with a top side 116 of extension member 102 adjacent an upper marginal edge 118 of notch 28 as shown in FIGS. 8 and 9. Referring to FIGS. 11 and 15, the opening 114 is disposed proximate a lateral edge 120 of rear side 112 in order to off-set extension member 102 toward the face side 122 of cabinet rail 10 to enable relatively flush mounting of the side opposite face side 122 of cabinet rail 10 to cabinet wall 124 as shown in FIG. 9. Although extension member 102 may be fabricated of any suitable material, exceptional success has been achieved using a resilient or semiresilient material such as rubber or plastic In use, cabinet rail 10 is mounted in a cabinet with the front side 108 of extension member 102 disposed beyond the front margin 104 of front end 14 of rail member 12 and extending slightly beyond the cabinet front to provide an abutment surface between the cabinet and the drawer front. Further, the bottom side 110 of extension member 102 is disposed below the bottom margin 106 of front end 14 and is aligned with a lower cabinet member 36 to space the cabinet rail 10 a pre-determined distance above the lower member 36 of the drawer opening 36. Likewise, the pre-determined distance is determined by the size of the corresponding Z-shaped pull-out rail and the distance required to enable the lower leg of the Z-shaped rail to clear the lower member 36 of the drawer opening 38.

While specific embodiments and features of the invention have been disclosed herein, it will be readily understood that the invention encompasses all enhancements and modifications within the scope and spirit of the following claims.

What is claimed is:

1. A cabinet rail for supporting a drawer in a furniture article having a drawer opening, the cabinet rail comprising:

an elongate rail member having a longitudinal axis and adapted to be mounted in the drawer opening and having front and rear ends and a U-shaped cross section with upper and lower ledges, the front end including a front margin and a bottom margin and a notch formed proximate the bottom margin of the front end with a section of the rail member formed on a lower side of the notch to define a projection on the front end of the rail member which extends substantially parallel to the longitudinal axis of the rail member;

a roller rotatably mounted on the rail member proximate the front end; and an extension member disposed on said projection and extending in at least one of a direction beyond the front margin and a direction below the bottom margin of the front end of the rail member.

2. The cabinet rail as claimed in claim 1, wherein the extension member extends in the direction beyond the front margin of the front end of the rail member.

3. The cabinet rail as claimed in claim 2, wherein the extension member is formed substantially as a parallelepiped with a front side disposed beyond the front margin.

4. The cabinet rail as claimed in claim 3, wherein the extension member has a rear side opposite the front side and an opening formed in the rear side which receives the projection of the rail member.

5. The cabinet rail as claimed in claim 4, wherein the extension member is made of a resilient or semiresilient material.

6. The cabinet rail as claimed in claim 5, wherein the resilient or semiresilient material is rubber or plastic.

7. The cabinet rail as claimed in claim 1, wherein the extension member extends in the direction below the bottom margin of the front end of the rail member.

8. The cabinet rail as claimed in claim 7, wherein the extension member is formed substantially as a parallelepiped with a bottom side disposed below the bottom margin.

9. The cabinet rail as claimed in claim 8, wherein the extension member has a rear side substantially perpendicular to the bottom side and an opening formed in the rear side which receives the projection of the rail member.

10. The cabinet rail as claimed in claim 9, wherein the extension member is made of a resilient or semiresilient material.

11. The cabinet rail as claimed in claim 10, wherein the resilient or semiresilient material is rubber or plastic.

12. The cabinet rail as claimed in claim 1, wherein the extension member extends both in the direction beyond the front margin and the direction below the bottom margin of the front end of the rail member.

13. The cabinet rail as claimed in claim 12, wherein the extension member is formed substantially as a parallelepiped with a front side disposed beyond the front margin and a bottom side disposed below the bottom margin of the front end of the rail member.

14. The cabinet rail a claimed in claim 13, wherein the extension member has a rear side opposite the front side and substantially perpendicular to the bottom side and an opening formed in the rear side which receives the projection of the rail member.

15. The cabinet rail as claimed in claim 14 wherein the extension member is made of a resilient or semiresilient material.

16. The cabinet rail as claimed in claim 15, wherein the resilient or semiresilient material is rubber or plastic.

17. A cabinet rail assembly for supporting a drawer in a furniture article, the cabinet rail assembly comprising:

a drawer opening formed in the furniture article, the drawer opening having a bottom edge;

a drawer front mounted on the drawer;

an elongate rail member having a longitudinal axis and mounted in the drawer opening and having front and rear ends and a U-shaped cross section with upper and lower ledges, the front end including a front margin and a bottom margin and a notch formed proximate the bottom margin of the front end with a section of the rail member formed on a lower side of the notch to define a projection on the front end of the rail member which extends substantially parallel to the longitudinal axis of the rail member;

a roller rotatably mounted on the rail member proximate the front end; and an extension member disposed on the projection and extending in at least one of a direction beyond the front margin of front end to form a stop for the drawer front and a direction below the bottom margin of the front end to space the rail member a pre-determined distance from the bottom edge of the drawer opening.

18. The drawer rail assembly as claimed in claim 17, wherein the extension member extends in the direction beyond the front margin of the front end of the rail member.

19. The drawer rail assembly as claimed in claim 17, wherein the extension member extends in the direction below the bottom margin of the front end of the rail member.

20. The drawer rail assembly as claimed in claim 17, wherein the extension member extends in both the direction beyond the front margin of the front end of the rail member and the direction below the bottom margin of the front end of the rail member.

* * * * *